US011098391B2

(12) United States Patent
Shih et al.

(10) Patent No.: US 11,098,391 B2
(45) **Date of Patent: *Aug. 24, 2021**

(54) ALUMINUM ALLOY WITH ADDITIONS OF MAGNESIUM, CALCIUM AND AT LEAST ONE OF CHROMIUM, MANGANESE AND ZIRCONIUM, AND METHOD OF MANUFACTURING THE SAME

(71) Applicants: The Boeing Company, Chicago, IL (US); Korea Institute of Industrial Technology, Cheonan (KR)

(72) Inventors: Donald S. Shih, Town and Country, MO (US); Paul N. Wilson, St. Charles, MO (US); Shae-Kwang Kim, Quebec (CA); Bong-Hwan Kim, Incheon (KR); Young-Ok Yoon, Incheon (KR)

(73) Assignees: The Boeing Company, Chicago, IL (US); Korea Institute of Industrial Technology, Cheonan (KR)

( * ) Notice: Subject to any disclaimer, the term of this patent is extended or adjusted under 35 U.S.C. 154(b) by 298 days.

This patent is subject to a terminal disclaimer.

(21) Appl. No.: 15/488,456

(22) Filed: Apr. 15, 2017

(65) Prior Publication Data

US 2018/0298473 A1 Oct. 18, 2018

(51) Int. Cl.

| | |
|---|---|
| ***C22C 21/06*** | (2006.01) |
| ***C22C 1/02*** | (2006.01) |
| ***C22C 1/03*** | (2006.01) |
| ***C22C 1/06*** | (2006.01) |

(52) U.S. Cl.

CPC ..... *C22C 21/06* (2013.01); *C22C 1/026* (2013.01); *C22C 1/03* (2013.01); *C22C 1/06* (2013.01)

(58) Field of Classification Search

CPC ..... C22C 21/06; C22C 21/08; C22C 1/026

See application file for complete search history.

(56) References Cited

U.S. PATENT DOCUMENTS

| | | | | |
|---|---|---|---|---|
| 4,140,556 | A * | 2/1979 | Baba | C22C 21/06 148/417 |
| 5,573,608 | A * | 11/1996 | Miyake | C22C 21/06 148/552 |
| 8,734,564 | B2 | 5/2014 | Kim et al. | |
| 8,808,423 | B2 | 8/2014 | Kim et al. | |
| 9,080,225 | B2 | 7/2015 | Kim et al. | |
| 9,085,815 | B2 | 7/2015 | Kim et al. | |

(Continued)

FOREIGN PATENT DOCUMENTS

| | | |
|---|---|---|
| CN | 1555423 | 12/2004 |
| CN | 102071342 | 5/2011 |

(Continued)

OTHER PUBLICATIONS

"Standard test methods for tension testing of metallic materials." ASTM. E8/E8M. p. 1-30 (Year: 2016).*

(Continued)

*Primary Examiner* — Nicholas A Wang

(74) *Attorney, Agent, or Firm* — Walters & Wasylyna LLC

(57) ABSTRACT

An aluminum alloy including aluminum, about 2.5 to about 17.4 weight percent by weight magnesium, about 50 to about 3000 ppm calcium, and at least one of chromium up to about 0.2 percent by weight, zirconium up to about 0.2 percent by weight and manganese up to about 0.3 percent by weight.

20 Claims, 4 Drawing Sheets

(56) References Cited

U.S. PATENT DOCUMENTS

| | | | | |
|---|---|---|---|---|
| 9,200,348 | B2 | 12/2015 | Kim et al. | |
| 2011/0123390 | A1 | 5/2011 | Kim et al. | |
| 2011/0123391 | A1* | 5/2011 | Kim | C22C 1/02 420/533 |
| 2014/0255249 | A1* | 9/2014 | Abe | C22C 21/08 420/542 |
| 2016/0047022 | A1* | 2/2016 | Nasserrafi | C22F 1/057 420/532 |

FOREIGN PATENT DOCUMENTS

| | | | |
|---|---|---|---|
| CN | 104864079 | * | 8/2015 |
| EP | 1 413 636 | | 4/2004 |

OTHER PUBLICATIONS

China National Intellectual Property Administration, Office Action, with English translation, App. No. 201810331554.8 (dated Jan. 5, 2021).

China National Intellectual Property Administration, Office Action, with English translation, App. No. 201810331554.8 (dated Jun. 17, 2021).

* cited by examiner

ALUMINUM ALLOY WITH ADDITIONS OF MAGNESIUM, CALCIUM AND AT LEAST ONE OF CHROMIUM, MANGANESE AND ZIRCONIUM, AND METHOD OF MANUFACTURING THE SAME

FIELD

The present application relates to aluminum alloys and methods for manufacturing aluminum alloys.

BACKGROUND

Aluminum alloys have relatively high strength-to-weight ratios. Therefore, aluminum alloys have been important in aerospace manufacturing since the introduction of metal-skinned aircraft. Various types of aluminum alloys have been developed. For example, the Aluminum Association of America has classified magnesium-containing aluminum alloys as 5000 series aluminum alloys.

Aluminum-magnesium alloys offer certain advantages (e.g., light weight) as compared to other traditional aluminum alloys. The addition of magnesium increases the strength of the aluminum alloy, makes the alloy more favorable to surface treatment, and improves corrosion resistance. However, when the magnesium content of aluminum-magnesium alloys increases, such as to 5 percent by weight or more, such alloys become difficult to cast. Furthermore, large intermetallic inclusions have been observed in high-magnesium-content aluminum-magnesium alloys, which tend to cause low ductility and degrade fatigue performance.

Accordingly, those skilled in the art continue with research and development efforts in the field of aluminum alloys.

SUMMARY

In one embodiment, the disclosed aluminum alloy includes aluminum, about 6 to about 17.4 percent by weight magnesium, and chromium up to about 0.2 percent by weight.

In another embodiment, the disclosed aluminum alloy includes aluminum, about 6 to about 17.4 percent by weight magnesium, and manganese up to about 0.3 percent by weight.

In another embodiment, the disclosed aluminum alloy includes aluminum, about 6 to about 17.4 percent by weight magnesium, and zirconium up to about 0.2 percent by weight.

In another embodiment, the disclosed aluminum alloy includes aluminum, about 6 to about 17.4 percent by weight magnesium, and at least one of chromium up to about 0.2 percent by weight, manganese up to about 0.3 percent by weight and zirconium up to about 0.2 percent by weight.

In another embodiment, the disclosed aluminum alloy includes aluminum, about 2.5 to about 17.4 percent by weight magnesium, about 50 to about 3000 ppm calcium, and chromium up to about 0.2 percent by weight.

In another embodiment, the disclosed aluminum alloy includes aluminum, about 2.5 to about 17.4 percent by weight magnesium, about 50 to about 3000 ppm calcium, and manganese up to about 0.3 percent by weight.

In another embodiment, the disclosed aluminum alloy includes aluminum, about 2.5 to about 17.4 percent by weight magnesium, about 50 to about 3000 ppm calcium, and zirconium up to about 0.2 percent by weight.

In yet another embodiment, the disclosed aluminum alloy includes aluminum, about 2.5 to about 17.4 percent by weight magnesium, about 50 to about 3000 ppm calcium, and at least one of chromium up to about 0.2 percent by weight, manganese up to about 0.3 percent by weight and zirconium up to about 0.2 percent by weight.

In one embodiment, the disclosed method for manufacturing an aluminum alloy includes the steps of preparing a magnesium master alloy containing calcium and adding the magnesium master alloy containing calcium into aluminum. The magnesium master alloy containing calcium can be prepared by the steps of forming a molten parent material by melting the parent material and adding a calcium-based compound into the molten parent material. The calcium-based compound could include calcium and at least one of magnesium, chromium, zirconium, titanium and aluminum. In the alternative, the calcium-based compound could include calcium and at least one of oxygen, cyanide, carbide, hydroxide and carbonate. The amount of calcium added may be proportional to the magnesium content.

In another embodiment, the disclosed method for manufacturing an aluminum alloy includes the steps of alloying beryllium and magnesium together to form a beryllium and magnesium alloy and subsequently adding the beryllium and magnesium alloy into aluminum.

In yet another embodiment, the disclosed method for manufacturing an aluminum alloy includes the steps of melting aluminum, magnesium and at least one of chromium, manganese, and zirconium to yield a molten mass, wherein the melting is performed under at least one of a vacuum and a surface flux, and cooling the molten mass to yield a solid mass.

Other embodiments of the disclosed aluminum alloy and method for manufacturing the same will become apparent from the following detailed description, accompanying drawings and the appended claims.

DETAILED DESCRIPTION

Figure 1:
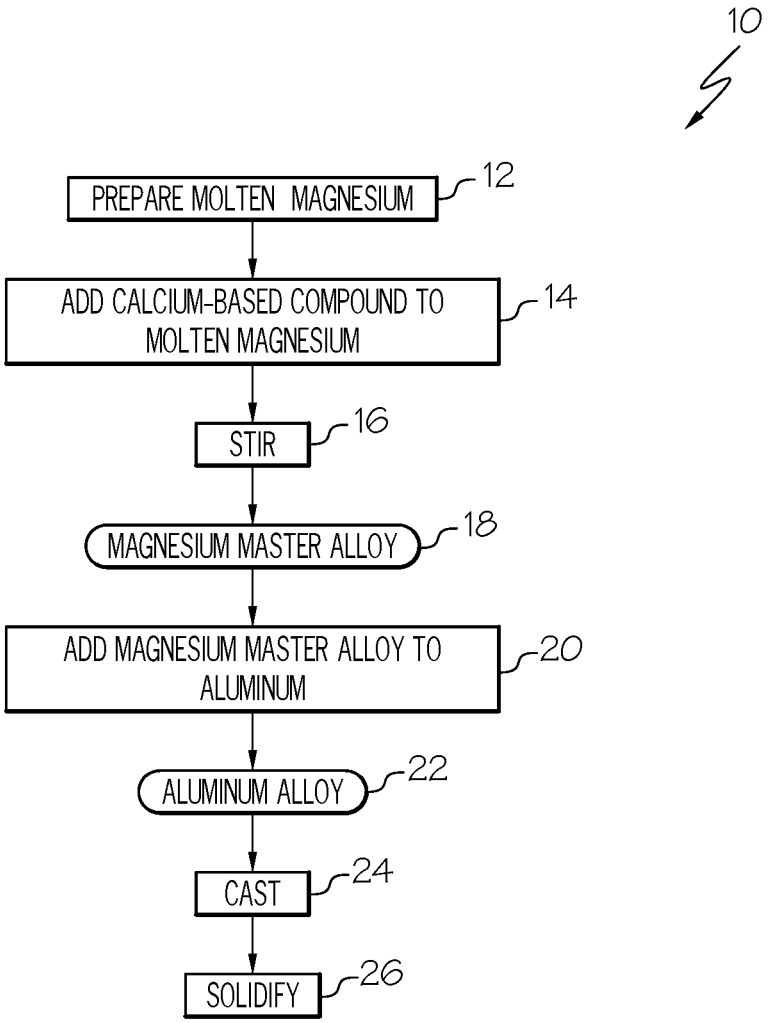
FIG. 1 is a flow diagram depicting one embodiment of the disclosed method for manufacturing an aluminum alloy.

Disclosed are aluminum alloys, particularly aluminum-magnesium alloys, with additions of at least one of chromium, manganese and zirconium, and optionally calcium. Various other elements traditionally used in aluminum alloys may also be present in the disclosed aluminum alloys.

The disclosed aluminum alloy may include magnesium at levels of about 2.5 to about 17.4 weight percent, such as about 6 to about 17.4 weight percent. The relatively high magnesium, as compared to traditional 5000 series alloys, which typically have a weight percentage of magnesium for commercial products at 5.0 percent or lower, may cause enhanced properties, such as increased ductility and strength. The additions of chromium and/or manganese and/or zirconium may suppress grain growth and recrystallization in the disclosed aluminum alloys.

In the disclosed aluminum alloys, the amounts of chromium, manganese and zirconium may be specifically tailored to the magnesium content of the aluminum alloy. In addition to chromium, manganese and zirconium, calcium may be also present in certain examples, and the calcium may also contribute to suppressing grain growth and recrystallization. The amount of calcium utilized may be specifically tailored to the magnesium content.

The disclosed aluminum alloys may present enhanced properties, such as improved tensile elongation. For example, the tensile elongation of the disclosed aluminum alloys may be at least about 10 percent greater than traditional 5000 series aluminum alloys, which may be a significant improvement in performance for aluminum-magnesium alloys with regards to formability, strain hardening and damage tolerance.

As a first general example, the disclosed aluminum alloy may have the composition shown in Table 1.

TABLE 1

| Element | Quantity |
|---|---|
| Magnesium | 2.5-17.4 wt % |
| Calcium | 50-3000 ppm |
| Chromium | Up to 0.2 wt % |
| Other elements | Zero to 20 wt % |
| Aluminum | Balance |

Thus, the aluminum alloy of Table 1 may include aluminum, about 2.5 to about 17.4 weight percent by weight magnesium, about 50 to about 3000 ppm calcium, and chromium at a non-zero quantity up to about 0.2 percent by weight. Additionally, the aluminum alloy of Table 1 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

In one variation to the aluminum alloy of Table 1, the disclosed aluminum alloy may include aluminum, about 6 to about 17.4 weight percent by weight magnesium, about 50 to about 3000 ppm calcium, and chromium at a non-zero quantity up to about 0.2 percent by weight. Additionally, the disclosed aluminum alloy may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a second general example, the disclosed aluminum alloy may have the composition shown in Table 2.

TABLE 2

| Element | Quantity |
|---|---|
| Magnesium | 2.5-17.4 wt % |
| Calcium | 50-3000 ppm |
| Manganese | Up to 0.3 wt % |
| Other elements | Zero to 20 wt % |
| Aluminum | Balance |

Thus, the aluminum alloy of Table 2 may include aluminum, about 2.5 to about 17.4 weight percent by weight magnesium, about 50 to about 3000 ppm calcium, and manganese at a non-zero quantity up to about 0.3 percent by weight. Additionally, the aluminum alloy of Table 2 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

In one variation of the aluminum alloy of Table 2, the disclosed aluminum alloy may include aluminum, about 6 to about 17.4 weight percent by weight magnesium, about 50 to about 3000 ppm calcium, and manganese at a non-zero quantity up to about 0.3 percent by weight. Additionally, the disclosed aluminum alloy may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a third general example, the disclosed aluminum alloy may have the composition shown in Table 3.

TABLE 3

| Element | Quantity |
|---|---|
| Magnesium | 2.5-17.4 wt % |
| Calcium | 50-3000 ppm |
| Zirconium | Up to 0.2 wt % |
| Other elements | Zero to 20 wt % |
| Aluminum | Balance |

Thus, the aluminum alloy of Table 3 may include aluminum, about 2.5 to about 17.4 weight percent by weight magnesium, about 50 to about 3000 ppm calcium, and zirconium at a non-zero quantity up to about 0.2 percent by weight. Additionally, the aluminum alloy of Table 3 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

In one variation of the aluminum alloy of Table 3, the disclosed aluminum alloy may include aluminum, about 6 to about 17.4 weight percent by weight magnesium, about 50 to about 3000 ppm calcium, and zirconium at a non-zero quantity up to about 0.2 percent by weight. Additionally, the disclosed aluminum alloy may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a fourth general example, the disclosed aluminum alloy may have the composition shown in Table 4.

TABLE 4

| Element | Quantity |
|---|---|
| Magnesium | 2.5-17.4 wt % |
| Calcium | 50-3000 ppm |
| Chromium | Up to 0.2 wt % |
| Zirconium | Up to 0.2 wt % |
| Manganese | Up to 0.3 wt % |
| Other elements | Zero to 20 wt % |
| Aluminum | Balance |

Thus, the aluminum alloy of Table 4 may include aluminum, about 2.5 to about 17.4 weight percent by weight magnesium, about 50 to about 3000 ppm calcium, and at least one of chromium at a non-zero quantity up to about 0.2 percent by weight, zirconium at a non-zero quantity up to about 0.2 percent by weight, and manganese at a non-zero quantity up to about 0.3 percent by weight. Additionally, the aluminum alloy of Table 4 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

In one variation of the aluminum alloy of Table 3, the disclosed aluminum alloy may include aluminum, about 6 to about 17.4 weight percent by weight magnesium, about 50 to about 3000 ppm calcium, and at least one of chromium at a non-zero quantity up to about 0.2 percent by weight, zirconium at a non-zero quantity up to about 0.2 percent by weight, and manganese at a non-zero quantity up to about 0.3 percent by weight. Additionally, the disclosed aluminum alloy may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a fifth general example, the disclosed aluminum alloy may have the composition shown in Table 5.

TABLE 5

| Element | Quantity |
|---|---|
| Magnesium | 6-17.4 wt % |
| Chromium | Up to 0.2 wt % |
| Beryllium | 0-100 ppm |
| Other elements | Zero to 20 wt % |
| Aluminum | Balance |

Thus, the aluminum alloy of Table 5 may include aluminum, about 6 to about 17.4 weight percent by weight magnesium, chromium at a non-zero quantity up to about 0.2 percent by weight, and optionally beryllium. Additionally, the aluminum alloy of Table 5 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a sixth general example, the disclosed aluminum alloy may have the composition shown in Table 6.

TABLE 6

| Element | Quantity |
|---|---|
| Magnesium | 6-17.4 wt % |
| Manganese | Up to 0.3 wt % |
| Beryllium | 0-100 ppm |
| Other elements | Zero to 20 wt % |
| Aluminum | Balance |

Thus, the aluminum alloy of Table 6 may include aluminum, about 6 to about 17.4 weight percent by weight magnesium, manganese at a non-zero quantity up to about 0.3 percent by weight, and optionally beryllium. Additionally, the aluminum alloy of Table 6 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a seventh general example, the disclosed aluminum alloy may have the composition shown in Table 7.

TABLE 7

| Element | Quantity |
|---|---|
| Magnesium | 6-17.4 wt % |
| Zirconium | Up to 0.2 wt % |
| Beryllium | 0-100 ppm |
| Other elements | Zero to 20 wt % |
| Aluminum | Balance |

Thus, the aluminum alloy of Table 7 may include aluminum, about 6 to about 17.4 weight percent by weight magnesium, zirconium at a non-zero quantity up to about 0.2 percent by weight, and optionally beryllium. Additionally, the aluminum alloy of Table 7 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As an eighth general example, the disclosed aluminum alloy may have the composition shown in Table 8.

TABLE 8

| Element | Quantity |
|---|---|
| Magnesium | 6-17.4 wt % |
| Chromium | Up to 0.2 wt % |
| Zirconium | Up to 0.2 wt % |
| Manganese | Up to 0.3 wt % |
| Beryllium | 0-100 ppm |
| Other elements | Zero to 20 wt % |
| Aluminum | Balance |

Thus, the aluminum alloy of Table 8 may include aluminum, about 6 to about 17.4 weight percent by weight magnesium, at least one of chromium at a non-zero quantity up to about 0.2 percent by weight, zirconium at a non-zero quantity up to about 0.2% and manganese at a non-zero quantity up to about 0.3 percent by weight, and optionally beryllium. Additionally, the aluminum alloy of Table 8 may include silicon up to about 1.4 percent by weight; iron up to about 1.2 percent by weight; copper up to about 0.8 percent by weight; nickel up to about 0.1 percent by weight; zinc up to about 2.8 percent by weight; gallium up to about 0.05 percent by weight; vanadium up to about 0.05 percent by weight; scandium up to about 0.05 percent by weight; and/or titanium up to about 0.20 percent by weight.

As a ninth general example, the disclosed aluminum alloy may have the composition shown in Table 9.

TABLE 9

| Element | Quantity |
|---|---|
| Mg | 2.5-17.4 (wt. %) |
| Ca | 0-3000 ppm |
| Cr | 0-0.2 (wt. %) |
| Mn | 0-0.3 (wt. %) |
| Zr | 0-0.2 (wt %) |
| Si | 0-1.4 (wt. %) |
| Fe | 0-1.2 (wt. %) |
| Cu | 0-0.8 (wt. %) |
| Ni | 0-0.1 (wt. %) |
| Zn | 0-2.8 (wt. %) |
| Ga | 0-0.05 (wt. %) |
| V | 0-0.05 (wt. %) |
| Sc | 0-0.05 (wt. %) |
| Ti | 0-0.20 (wt. %) |
| Be | 0-100 ppm |
| Al | Balance |

In the general example of Table 9, at least one of Cr, Zr and Mn is present in a non-zero quantity up to the specified limit.

Various impurities, which do not substantially affect physical properties, may also be present in the disclosed aluminum alloys. Those skilled in the art will appreciate that the presence of such impurities will not result in a departure from the scope of the present disclosure.

Also disclosed are methods for manufacturing the disclosed aluminum alloys. The final composition of a manufactured aluminum alloy may depend on the manufacturing method used.

In a first embodiment, the disclosed method for manufacturing an aluminum alloy yields an aluminum alloy that includes aluminum, about 2.5 to about 17.4 percent by weight magnesium, about 50 to about 3000 ppm calcium, and at least one of chromium up to about 0.2 percent by weight, zirconium up to about 0.2 percent by weight and manganese up to about 0.3 percent by weight. The disclosed method includes steps of (1) preparing a magnesium master alloy comprising calcium and (2) adding said magnesium master alloy to aluminum (either pure or alloyed).

Referring to FIG. 1, the method for manufacturing an aluminum alloy in accordance with the first embodiment, generally designated 10, may begin at Block 12 with the step of preparing molten magnesium. The magnesium (either pure or alloyed) may be placed into a crucible and heated to a temperature ranging from about 400° C. to about 800° C. The melting temperate may vary depending on composition.

At Block 14, the molten magnesium is combined with a calcium-based compound. Various calcium-based compounds may be used. As one general, non-limiting example, the calcium-based compound may include calcium and aluminum. As another general, non-limiting example, the calcium-based compound may include calcium and magnesium. Specific, non-limiting examples of suitable calcium-based compounds include CaO, $CaCN_2$, $CaC_2$, $Ca(OH)_2$, $CaCO_3$, $Mg_2Ca$, $Al_2Ca$, $Al_4Ca$, $(Mg, Al)_2Ca$, and combinations thereof.

At Block 16, the mixture of the molten magnesium and the calcium-based compound may be stirred to promote a reaction between the magnesium and the calcium-based compound and, ultimately, to yield a magnesium master alloy 18. Stirring (Block 16) may be performed by generating an electromagnetic field using a device capable of applying electromagnetic fields around the furnace holding the molten magnesium, thus enabling the convection of the molten magnesium to be induced. Also, artificial stirring (mechanical stirring) may be performed on the molten magnesium from the outside.

At Block 20, the magnesium master alloy is added to aluminum (either pure or alloyed) to yield the disclosed aluminum alloy 22. At Block 24, casting may be performed by pouring the aluminum alloy 22 into a mold at room temperature or in a pre-heated state. The mold may be a metallic mold, a ceramic mold, a graphite mold or the like. Also, the casting may include gravity casting, continuous casting and equivalent methods thereof. In the solidifying step, Block 26, the mold may be cooled down to room temperature and, thereafter, the solidified aluminum alloy may be removed from the mold. Subsequently, though optionally, the solidified aluminum alloy may undergo further processing, such as heat treatment and/or forming (e.g., hot/warm forming).

In a second embodiment, the disclosed method for manufacturing an aluminum alloy yields an aluminum alloy that includes aluminum, about 6 to about 17.4 percent by weight magnesium, beryllium, and at least one of chromium up to about 0.2 percent by weight, zirconium up to about 0.2 percent by weight and manganese up to about 0.3 percent by weight. The disclosed method includes steps of (1) alloying beryllium and magnesium together to form a beryllium and magnesium alloy and (2) adding the beryllium and magnesium alloy to aluminum. The beryllium may be present at 5 ppm to 100 ppm.

Figure 2:
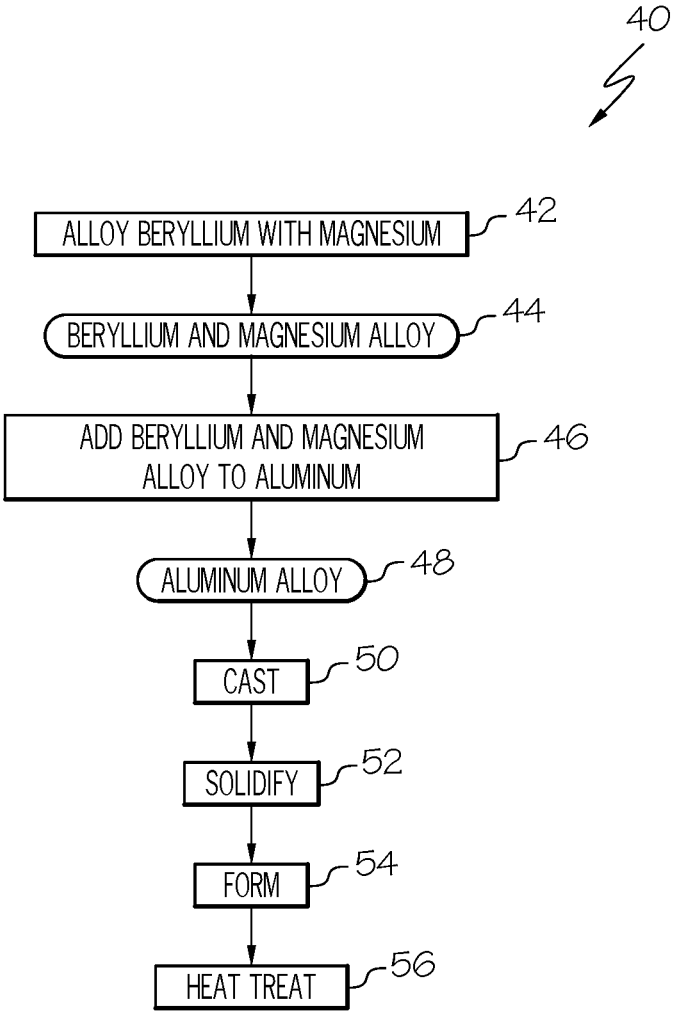
FIG. 2 is a flow diagram depicting another embodiment of the disclosed method for manufacturing an aluminum alloy.

Referring to FIG. 2, the method for manufacturing an aluminum alloy in accordance with the second embodiment, generally designated 40, may begin at Block 42 with the step of alloying magnesium (e.g., pure magnesium) with beryllium (e.g., pure beryllium) to yield a beryllium and magnesium alloy 44. For example, the alloying step (Block 42) may include melting the magnesium and the beryllium at a temperature ranging from about 400° C. to about 800° C.

At Block 46, the beryllium and magnesium alloy 44 is added to aluminum (pure or alloyed) to yield the disclosed aluminum alloy 48. At Block 50, casting may be performed by pouring the aluminum alloy 48 into a mold at room temperature or in a pre-heated state. The mold may be a metallic mold, a ceramic mold, a graphite mold or the like. Also, the casting may include gravity casting, continuous casting and equivalent methods thereof. In the solidifying step, Block 52, the mold may be cooled down to room temperature and, thereafter, the solidified aluminum alloy may be removed from the mold. Subsequently, though optionally, the solidified aluminum alloy may undergo further processing, such as hot/warm forming (Block 54) and/or heat treatment (Block 56), such as homogenization or the like. The optional forming (Block 54) and heat treatment (Block 56) steps may be performed under a protective blanket of $SO_2$ gas.

In a third embodiment, the disclosed method for manufacturing an aluminum alloy yields an aluminum alloy that includes aluminum, about 6 to about 17.4 percent by weight magnesium, and at least one of chromium up to about 0.2 percent by weight, zirconium up to about 0.2 percent by weight and manganese up to about 0.3 percent by weight.

The disclosed method includes steps of (1) melting aluminum, magnesium and at least one of chromium, zirconium, and manganese to yield a molten mass and (2) cooling the molten mass to yield a solid mass.

Figure 3:
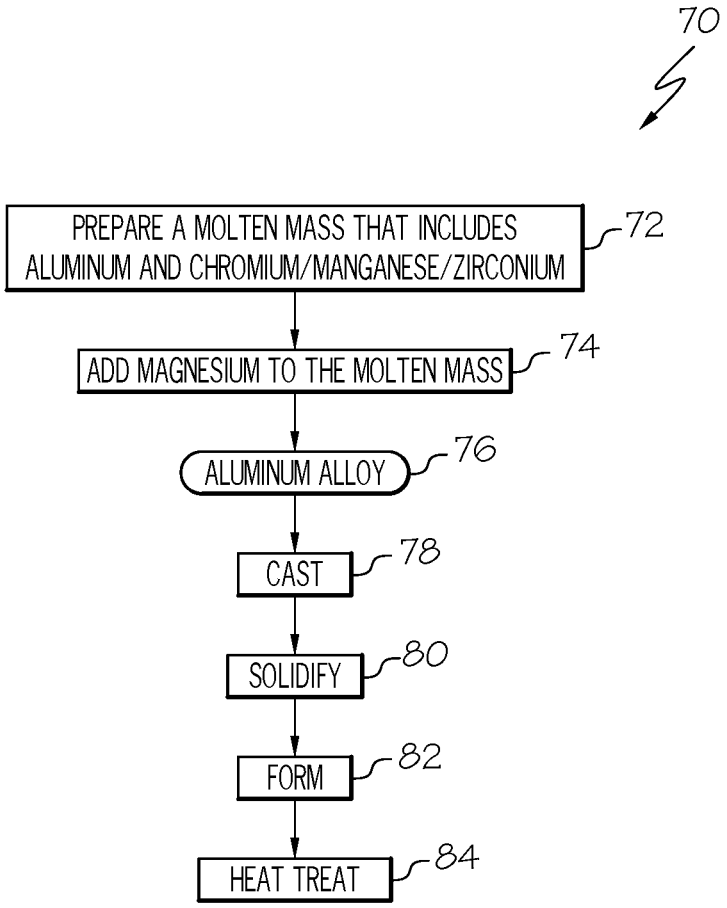
FIG. 3 is a flow diagram depicting yet another embodiment of the disclosed method for manufacturing an aluminum alloy.

Referring to FIG. 3, the method for manufacturing an aluminum alloy in accordance with the third embodiment, generally designated 70, may begin at Block 72 with the step of preparing a molten mass that includes aluminum and at least one of chromium, zirconium, and manganese. The molten mass may be heated to a temperature ranging from about 400° C. to about 800° C.

At Block 74, magnesium (e.g., pure magnesium) may be added to the molten mass of aluminum and at least one of chromium, zirconium, and manganese to yield the disclosed aluminum alloy 76. In one implementation, the addition of magnesium to the molten mass (Block 74) may be performed under vacuum. In another implementation, a surface flux may be used prior to the addition of magnesium to the molten mass (Block 74).

At Block 78, casting may be performed by pouring the aluminum alloy 76 into a mold at room temperature or in a pre-heated state. The mold may be a metallic mold, a ceramic mold, a graphite mold or the like. Also, the casting may include gravity casting, continuous casting and equivalent methods thereof. In the solidifying step, Block 80, the mold may be cooled down to room temperature and, thereafter, the solidified aluminum alloy may be removed from the mold. Subsequently, though optionally, the solidified aluminum alloy may undergo further processing, such as hot/warm forming (Block 82) and/or heat treatment (Block 84), such as homogenization or the like. The optional forming (Block 82) and heat treatment (Block 84) steps may be performed under a protective blanket of $SO_2$ gas.

EXAMPLES

Examples 1-13

Presented in Table 10 are ten specific, non-limiting examples of the disclosed aluminum alloy, specifically, Al—Mg—Cr—Ca alloys.

TABLE 10

| Alloy # | Mg Quantity (wt %) | Cr Quantity (wt %) | Ca Quantity (ppm) | Al Quantity |
|---|---|---|---|---|
| 1 | 3 | 0.15 | 300 | Balance |
| 2 | 4 | 0.13 | 400 | Balance |
| 3 | 5 | 0.1 | 500 | Balance |
| 4 | 6 | 0.09 | 600 | Balance |
| 5 | 7 | 0.07 | 700 | Balance |
| 6 | 8 | 0.05 | 800 | Balance |
| 7 | 9 | 0.04 | 900 | Balance |
| 8 | 10 | 0.02 | 1000 | Balance |
| 9 | 11 | 0.02 | 1100 | Balance |
| 10 | 12 | 0.01 | 1200 | Balance |
| 11 | 13 | 0.01 | 1300 | Balance |
| 12 | 14 | 0.01 | 1400 | Balance |
| 13 | 15 | 0.01 | 1500 | Balance |

Examples 14-26

Presented in Table 11 are ten specific, non-limiting examples of the disclosed aluminum alloy, specifically, Al—Mg—Mn—Ca alloys.

TABLE 11

| Alloy # | Mg Quantity (wt %) | Mn Quantity (wt %) | Ca Quantity (ppm) | Al Quantity |
|---|---|---|---|---|
| 14 | 3 | 0.2 | 300 | Balance |
| 15 | 4 | 0.2 | 400 | Balance |
| 16 | 5 | 0.2 | 500 | Balance |
| 17 | 6 | 0.2 | 600 | Balance |
| 18 | 7 | 0.2 | 700 | Balance |
| 19 | 8 | 0.15 | 800 | Balance |
| 20 | 9 | 0.15 | 900 | Balance |
| 21 | 10 | 0.1 | 1000 | Balance |
| 22 | 11 | 0.1 | 1100 | Balance |
| 23 | 12 | 0.1 | 1200 | Balance |
| 24 | 13 | 0.08 | 1300 | Balance |
| 25 | 14 | 0.05 | 1400 | Balance |
| 26 | 15 | 0.05 | 1500 | Balance |

Examples 27-39

Presented in Table 12 are ten specific, non-limiting examples of the disclosed aluminum alloy, specifically, Al—Mg—Cr—Mn—Ca alloys.

TABLE 12

| Alloy # | Mg Quantity (wt %) | Cr Quantity (wt %) | Mn Quantity (wt %) | Ca Quantity (ppm) | Al Quantity |
|---|---|---|---|---|---|
| 27 | 3 | 0.13 | 0.15 | 300 | Balance |
| 28 | 4 | 0.11 | 0.15 | 400 | Balance |
| 29 | 5 | 0.09 | 0.15 | 500 | Balance |
| 30 | 6 | 0.06 | 0.125 | 600 | Balance |
| 31 | 7 | 0.05 | 0.125 | 700 | Balance |
| 32 | 8 | 0.04 | 0.1 | 800 | Balance |
| 33 | 9 | 0.03 | 0.1 | 900 | Balance |
| 34 | 10 | 0.02 | 0.08 | 1000 | Balance |
| 35 | 11 | 0.01 | 0.07 | 1100 | Balance |
| 36 | 12 | 0.008 | 0.05 | 1200 | Balance |
| 37 | 13 | 0.008 | 0.04 | 1300 | Balance |
| 38 | 14 | 0.008 | 0.03 | 1400 | Balance |
| 39 | 15 | 0.008 | 0.02 | 1500 | Balance |

Examples 40-52

Presented in Table 13 are ten specific, non-limiting examples of the disclosed aluminum alloy, specifically, Al—Mg—Zr—Ca alloys.

TABLE 13

| Alloy # | Mg Quantity (wt %) | Zr Quantity (wt %) | Ca Quantity (ppm) | Al Quantity |
|---|---|---|---|---|
| 40 | 3 | 0.06 | 300 | Balance |
| 41 | 4 | 0.05 | 400 | Balance |
| 42 | 5 | 0.04 | 500 | Balance |
| 43 | 6 | 0.03 | 600 | Balance |
| 44 | 7 | 0.025 | 700 | Balance |
| 45 | 8 | 0.02 | 800 | Balance |
| 46 | 9 | 0.015 | 900 | Balance |
| 47 | 10 | 0.015 | 1000 | Balance |
| 48 | 11 | 0.01 | 1100 | Balance |
| 49 | 12 | 0.01 | 1200 | Balance |
| 50 | 13 | 0.01 | 1300 | Balance |
| 51 | 14 | 0.01 | 1400 | Balance |
| 52 | 15 | 0.01 | 1500 | Balance |

Table 14 below shows the mechanical properties of certain Al—Mg—Cr—Mn—Ca alloys from Table 12. The levels of Cr and Mn are optimized in relation to Mg, combined in the presence of optimized Ca, to yield alloys with improved ductility and elongation over non-optimized alloys.

TABLE 14

Mechanical Properties of Al—Mg—Cr—Mn—Ca Alloys with Mg from 6% to 9%, Cr and Mn levels optimized.

| Alloy | Yield Strength (MPa) | Ultimate Tensile Strength (MPa) | Elongation (%) |
|---|---|---|---|
| Example 30 | 145 | 321 | 36.2 |
| Example 31 | 162 | 358 | 35.7 |
| Example 33 | 231 | 434 | 36.9 |

Comparative Examples C1-C3

Table 15 shows examples of Al—Mg—Ca alloy compositions with 5 wt % magnesium (Example C1), 7 wt % magnesium (Example C2) and 9 wt % magnesium (Example C3). Examples C1-C3 were produced utilizing the same general process (see FIG. 1) as the examples of Table 10, but without the disclosed quantities of chromium, manganese and/or zirconium.

TABLE 15

Mechanical Properties of Al—Mg—Ca Alloys with Mg from 5% to 9%, Cr, Mn and/or Zr levels not optimized.

| Alloy | Yield Strength (MPa) | Ultimate Tensile Strength (MPa) | Elongation (%) |
|---|---|---|---|
| Example C1 | 145 | 296 | 25 |
| Example C2 | 235 | 412 | 23.0 |
| Example C3 | 274 | 470 | 27.3 |

It is apparent after viewing Table 14 and Table 15 that an improvement in properties from non-optimized to optimized alloys is exemplified in the improved value of the tensile elongation. In this regard, tensile elongation is at least about 10% greater in the optimized alloys as shown in Table 14, compared to the non-optimized alloys of Table 15. In the disclosed aluminum alloys of Table 14, the elongation is at least 35%, whereas the non-optimized alloys of Table 15 have elongation of less than 28%.

For example, Example 30 of Table 14 includes 6 wt % magnesium and calcium (600 ppm), and optimized amounts of chromium (0.06 wt %) and manganese (0.125 wt %), and has an elongation of 36.2 percent, whereas Example C1 of Table 15 includes 6 wt % magnesium and calcium, but without optimized amounts of chromium and manganese, resulting in an elongation of 25 percent. This is a difference of over 11 percent. Example 31 of Table 14 includes 7 wt % magnesium and calcium (700 ppm), and optimized amounts of chromium (0.05 wt %) and manganese (0.125 wt %), and has an elongation of 35.7 percent, whereas Example C2 of Table 15 includes 7 wt % magnesium and calcium, but without optimized amounts of chromium and manganese, resulting in an elongation of 23 percent. This is a difference of over 12 percent. Example 33 of Table 14 includes 9 wt % magnesium and calcium (900 ppm), and optimized amounts of chromium (0.03 wt %) and manganese (0.1 wt %), and has an elongation of 36.9 percent, whereas Example C3 of Table 15 includes 9 wt % magnesium and calcium, but without optimized amounts of chromium and manganese, resulting in an elongation of 27.3 percent. This is a difference of almost 10 percent. These elongation differences show an improvement in the performance of the disclosed aluminum alloys, in particular with regards to formability, strain hardening and damage tolerance.

Figure 4:
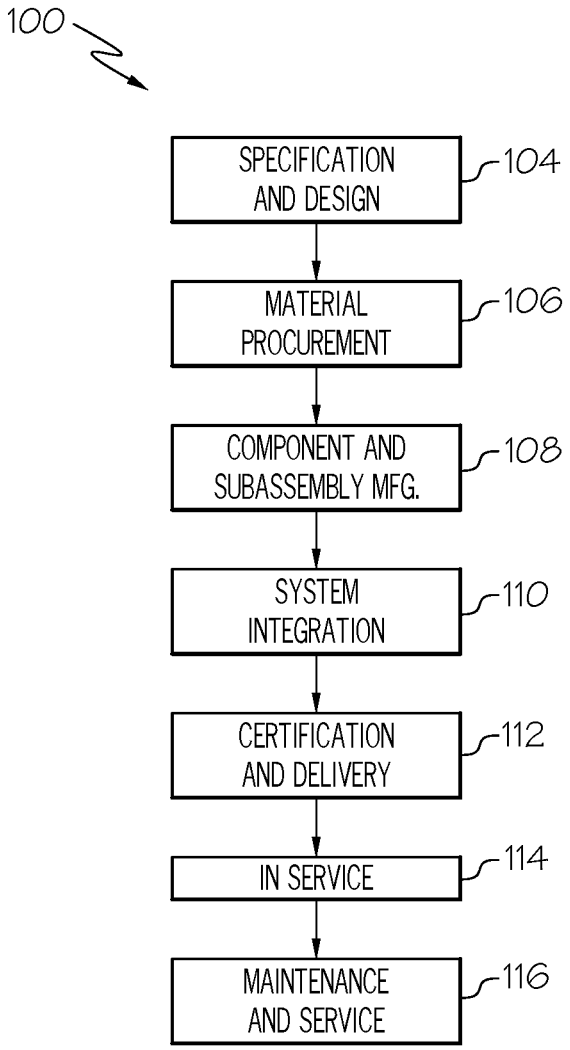
FIG. 4 is a flow diagram of an aircraft manufacturing and service methodology.
Figure 5:
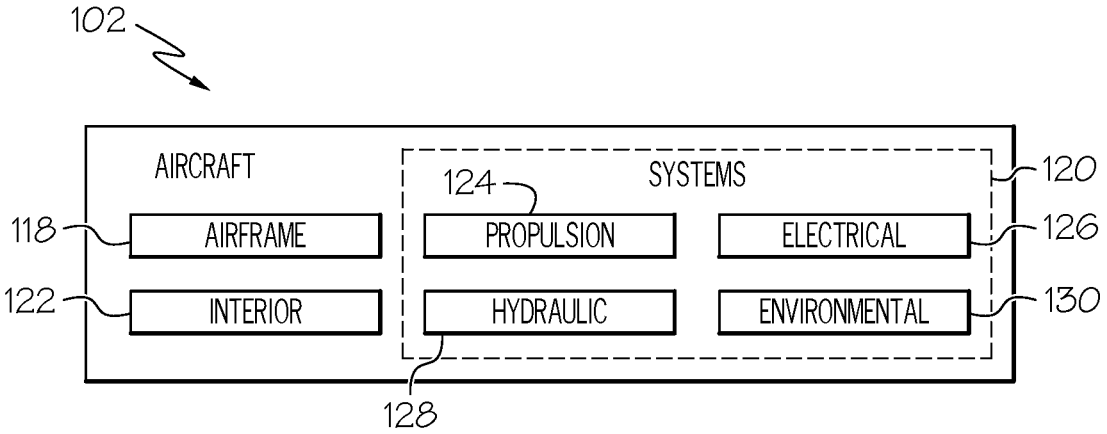
FIG. 5 is a block diagram of an aircraft.

Examples of the disclosure may be described in the context of an aircraft manufacturing and service method 100, as shown in FIG. 4, and an aircraft 102, as shown in FIG. 5. During pre-production, the aircraft manufacturing and service method 100 includes, for example, specification and design 104 of the aircraft 102 and material procurement 106. During production, component/subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116, which may also include modification, reconfiguration, refurbishment and the like.

Each of the processes of method 100 may be performed or carried out by a system integrator, a third party, and/or an operator (e.g., a customer). For the purposes of this description, a system integrator includes, without limitation, any number of aircraft manufacturers and major-system subcontractors; a third party includes, without limitation, any number of venders, subcontractors, and suppliers; and an operator may be an airline, leasing company, military entity, service organization, and so on.

As shown in FIG. 5, the aircraft 102 produced by example method 100 includes, for example, an airframe 118 with a plurality of systems 120 and an interior 122. Examples of the plurality of systems 120 include one or more of a propulsion system 124, an electrical system 126, a hydraulic system 128, and an environmental system 130. Any number of other systems may be included.

The disclosed aluminum alloy may be employed during any one or more of the stages of the aircraft manufacturing and service method 100. As one example, components or subassemblies corresponding to component/subassembly manufacturing 108, system integration 110, and or maintenance and service 116 may be fabricated or manufactured using the disclosed aluminum alloy. As another example, the airframe 118 may be constructed using the disclosed aluminum alloy. Also, one or more apparatus examples, method examples, or a combination thereof may be utilized during component/subassembly manufacturing 108 and/or system integration 110, for example, by substantially expediting assembly of or reducing the cost of an aircraft 102, such as the airframe 118 and/or the interior 122. Similarly, one or more of system examples, method examples, or a combination thereof may be utilized while the aircraft 102 is in service, for example and without limitation, to maintenance and service 116.

The disclosed aluminum alloy is described in the context of an aircraft; however, one of ordinary skill in the art will readily recognize that the disclosed aluminum alloy may be utilized for a variety of applications. For example, the disclosed aluminum alloy may be implemented in various types of vehicles including, for example, helicopters, passenger ships, automobiles, marine products (boat, motors, etc.) and the like.

Although various embodiments of the disclosed aluminum alloy and method for manufacturing the same have been shown and described, modifications may occur to those skilled in the art upon reading the specification. The present application includes such modifications and is limited only by the scope of the claims.

What is claimed is:

1. An aluminum alloy comprising:
aluminum;
12 to about 17.4 percent by weight magnesium;
about 50 to about 3000 ppm calcium;
about 0.01 to 0.1 percent by weight chromium;
wherein, if present, manganese is up to about 0.3 percent by weight;
wherein, if present, zirconium is up to about 0.2 percent by weight, and
wherein, if present, copper is up to about 0.3 percent by weight;
the aluminum alloy having a tensile elongation at room temperature of at least 30 percent.

2. The aluminum alloy of claim 1 comprising said manganese.

3. The aluminum alloy of claim 2 wherein said manganese is present at about 0.01 to about 0.2 percent by weight.

4. The aluminum alloy of claim 1 comprising said zirconium.

5. The aluminum alloy of claim 4 wherein said zirconium is present at about 0.01 to about 0.1 percent by weight.

6. The aluminum alloy of claim 1 wherein said calcium is present at about 50 to about 2000 ppm.

7. The aluminum alloy of claim 1 wherein said calcium is present at about 500 ppm to about 1600 ppm.

8. The aluminum alloy of claim 1 further comprising at least one of:
silicon up to about 1.4 percent by weight;
iron up to about 1.2 percent by weight;
nickel up to about 0.1 percent by weight;
zinc up to about 2.8 percent by weight;
gallium up to about 0.05 percent by weight;
vanadium up to about 0.05 percent by weight;
scandium up to about 0.05 percent by weight; and
titanium up to about 0.20 percent by weight.

9. The aluminum alloy of claim 1 wherein said aluminum alloy consists essentially of said aluminum, said magnesium, said calcium, and at least one of said chromium, said manganese and said zirconium.

10. The aluminum alloy of claim 1 wherein said magnesium is present at 13 to about 17.4 percent by weight.

11. The aluminum alloy of claim 1 wherein said magnesium is present at 14 to about 17.4 percent by weight.

12. The aluminum alloy of claim 1 wherein said magnesium is present at 15 to about 17.4 percent by weight.

13. The aluminum alloy of claim 1 wherein the aluminum alloy is prepared by preparing a magnesium master alloy comprising calcium and adding said magnesium master alloy to aluminum.

14. The aluminum alloy of claim 1 wherein, if present, copper is up to 0.2 percent by weight.

15. The aluminum alloy of claim 1 wherein, if present, copper is up to 0.1 percent by weight.

16. The aluminum alloy of claim 1 wherein an amount of copper is substantially zero.

17. A method for manufacturing said aluminum alloy of claim 1 comprising:
preparing a magnesium master alloy comprising calcium; and
adding said magnesium master alloy to aluminum.

18. The method of claim 17 wherein said preparing said magnesium master alloy comprises:
melting a parent material comprising magnesium to yield a molten parent material; and
adding a calcium-based compound to said molten parent material.

19. The method of claim 18 wherein said calcium-based compound comprises calcium and at least one of magnesium and aluminum.

20. The method of claim 18 wherein said calcium-based compound is selected from the group consisting of CaO, $CaCN_2$, $CaC_2$, $Ca(OH)_2$, $CaCO_3$, $Mg_2Ca$, $Al_2Ca$, $Al_4Ca$, $(Mg, Al)_2Ca$, and combinations thereof.

* * * * *